United States Patent [19]

Ruble

[11] Patent Number: 4,998,840

[45] Date of Patent: Mar. 12, 1991

[54] METHOD AND TOOL FOR RETROFITTING AN ELONGATED LABEL LEADER INTO THE SLOT OF AN OVERLAY BINDER

[76] Inventor: Paul E. Ruble, 249 Devia Dr., Newbury Park, Calif. 91320

[21] Appl. No.: 537,056

[22] Filed: Jun. 12, 1990

[51] Int. Cl.[5] ..... B42F 1/00; B42D 19/00

[52] U.S. Cl. ..... 402/3; 281/15.1; 281/31; 281/36; 402/80 R

[58] Field of Search ..... 402/3, 73, 80 R; 281/37, 15.1, 29, 36, 31

[56] References Cited

U.S. PATENT DOCUMENTS

| | | | |
|---|---|---|---|
| 1,677,277 | 7/1928 | Federbush et al. | 402/3 |
| 1,805,314 | 5/1931 | Morton | 402/3 |
| 4,681,472 | 7/1987 | Ruble | 402/3 |
| 4,892,333 | 1/1990 | Krulich | 281/31 |

FOREIGN PATENT DOCUMENTS

| | | | |
|---|---|---|---|
| 313576 | 6/1956 | Canada | 402/3 |
| 2656021 | 6/1978 | Fed. Rep. of Germany | 402/3 |

*Primary Examiner*—Paul A. Bell
*Assistant Examiner*—Hwei-Siu Payer
*Attorney, Agent, or Firm*—Koppel & Jacobs

[57] ABSTRACT

A loose-leaf binder (10) or other bound volume has a slot (24) defined between the outer surface of a spine (12) thereof, and a transparent overlay (22) attached over the spine (12), into which a label (30) can be inserted. The cover (22) is sealed to the spine (12) along its longitudinal edges (46). An elongated, flexible label leader (26) is designed to extend through the slot (24) and protrude therefrom at its opposite ends. An adhesive portion (28) is formed at one end of the leader (26). The label (30) may be inserted into the slot (24) by releasably adhering one end of the label (30) to the adhesive portion (28) of the leader (26), and pulling on the other end of the leader (26), thereby pulling the attached label (30) into the slot (24). The binder (10) may be retrofit with a label leader (26) by inserting a narrow, thin tool (40) into the slot (24) such that the opposite ends of the tool (40) protrude from the ends of the slot (24), releasably adhering the adhesive portion (28) of the leader (26) to one end of the tool (40), and pulling on the other end of the tool (40) such that the leader (26) is pulled into the slot (24) and the adhesive portion (28) of the leader (26) operatively protrudes from the slot (24). Where one transverse edge (**22*a*,22*b*) of the cover (22) is initially sealed to the spine (12), one end of the tool (40) may be formed with a sharp cutting edge (44) for puncturing the sealed edge (22*a*,22*b*) of the cover (22) to enable the tool (40) and leader (26**) to pass therethrough.

20 Claims, 4 Drawing Sheets

METHOD AND TOOL FOR RETROFITTING AN ELONGATED LABEL LEADER INTO THE SLOT OF AN OVERLAY BINDER

BACKGROUND OF THE INVENTION

1. Field of the Invention

The present invention relates to an improved method and tool for removably retrofitting an elongated label leader into a slot of an overlay on a bound work such as a loose-leaf binder.

2. Description of the Related Art

The present invention constitutes an improvement to my "SELF-LOADING BINDER" disclosed in U.S. Pat. No. 4,681,472, issued July 21, 1987. Loose-leaf binders and other bound works may be conveniently provided with transparent overlays on the spines thereof which are sealed along their longitudinal edges to the spine. An elongated pocket or slot is defined between the cover and spine into which a label may be inserted to identify the contents of the bound work. This arrangement is highly preferable to conventional expedients such as affixing an adhesive label to the outer surface of the spine, since a label attached in the present manner is protected from wear and tear by the durable overlay.

Without the improvement disclosed in my prior patent, a label is difficult to insert into such a slot due to the length of the slot, and the fact that the overlay fits tightly over the spine. Attempts to insert a label into the slot will generally result in folds being created in the center portion of the label by the force used to push the label into the slot. Additional damage may also be done to the binder spine and/or overlay if a pen, paper clip, or similar sharp object is used to force the label into the slot.

The arrangement disclosed in my prior patent is illustrated in FIGS. 1 and 2. A bound work, here shown as being a loose-leaf binder 10, includes an end cover or spine 12, and front and rear covers 14 and 16 which are attached to the spine 12 along longitudinal edges 18 and 20 thereof respectively. A transparent overlay 22 is sealed to the spine 12 along or adjacent to the longitudinal edges 18 and 20 to define a pocket or slot 24 between itself and the surface of the spine 12.

In order to enable a label made of flexible paper or the like to be inserted into the slot 24 for identification of the contents of the binder 10, a thin, flexible leader 26 extends through the slot 24 and protrudes therefrom at its opposite ends. As viewed in FIG. 1, the upper end of the leader 26 has a releasable adhesive portion 28 formed thereon which faces away from the binder 10. The leader 26 is long enough so that the ends thereof may be folded back over the spine 20, with the adhesive portion 28 on the upper end being releasably adhered to the facing surface of the lower end of the leader 26 as illustrated in FIG. 2. The ends of the leader 26 are thereby secured together in a convenient and compact manner over the spine 12 of the binder 10 for storage, shipping and sales.

FIGS. 3*a* to 3*d* are simplified diagrams illustrating how the leader 26 is used to insert a label into the slot 24 in accordance with my prior patent. These figures, as well as similar figures which will be referenced below, are not drawn to scale, but are compressed in the vertical direction to facilitate description of the invention.

As viewed in FIG. 3*a*, the lower end portion of a flexible label 30 is pressed down onto the adhesive portion 28 of the leader 26 and releasably adhered thereto. As illustrated in FIG. 3*b*, the lower end of the leader 26 is then gripped and pulled downwardly, thereby pulling the label 30 downwardly into the slot 24. FIG. 3*b* shows the label 30 as being pulled approximately half way into the slot 24, whereas in FIG. 3*c* the label 30 has been pulled all the way into the slot 24. The leader 26 is released from the label 30 by applying finger pressure to the overlay 22 at a position such as designated by a cross 32 to immobilize the label 30, and then pulling down on the leader 26 with increased force until the adhesive portion 28 releases or detaches from the label 30 as shown in FIG. 3*d*.

Although not illustrated, the leader 26 may be used to remove the label 30 from the slot 24 by inserting the leader 26 into the upper end of the slot 24 between the spine 12 and label 30 with the adhesive portion 28 facing the label 30. Finger pressure is applied to adhere the adhesive portion 28 to the label 30. The leader 26 is then pulled upwardly, thereby pulling the label 30 out of the slot 24 through the top (opposite to the direction in which the label was inserted into the slot).

The upper and lower traverse ends of the overlay 22 may both be not sealed to the spine 12, thereby providing the slot 24 with open upper and lower ends. Alternatively, the lower transverse end of the overlay 22 may be sealed to the spine as indicated at 34, and cut away at a central portion 36 which is slightly wider than the leader 26. This provides a stop for the lower end of the label 30, while still enabling the leader 26 to protrude through both ends of the slot 24.

In accordance with my prior patent, the leader 26 is assembled as an integral part of the binder 10 or other bound work by placing the leader 26 on the spine 12 of the binder 10, and fusing the longitudinal edges and lower transverse end 34 of the overlay 22 to the spine 12 using a high frequency sealing or other appropriate process.

It is desirable, however, to retrofit binders which have been manufactured with overlays and label slots, but not label leaders. These binders have one transverse end of the slot completely sealed in addition to the longitudinal edges, with only one transverse end of the slot left open for insertion of a label. Manual insertion of label leaders into the slots of such binders is impossible with one transverse end of the slot sealed.

SUMMARY OF THE INVENTION

The present invention overcomes the drawbacks of the prior art and enables binders which were manufactured without label leaders to be quickly and easily retrofit. A loose-leaf binder or other bound volume has a slot defined between the outer surface of a spine thereof, and a transparent overlay attached over the spine, into which a label can be inserted. The cover is sealed to the spine along its longitudinal edges. An elongated, flexible label leader is designed to extend through the slot and protrude therefrom at its opposite ends. An adhesive portion is formed at one end of the leader. A label may be inserted into the slot by releasably adhering one end of the label to the adhesive portion of the leader, and pulling on the other end of the leader, thereby pulling the attached label into the slot.

In accordance with the improvement of the present invention, a binder may be retrofit with a label leader by inserting a narrow, thin tool into the slot such that the opposite ends of the tool protrude from the ends of the slot, releasably adhering the adhesive portion of the leader to one end of the tool, and pulling on the other end of the tool such that the leader is pulled into the slot and the adhesive portion of the leader operatively protrudes from the slot, so as to make the binder retrofit as in my prior patent. Alternatively, gripping means may be provided at an end of the tool for releasably gripping the end of the leader opposite to the end on which the adhesive portion is formed with sufficient force to pull the leader through the slot.

Where one transverse edge of the cover is initially sealed to the spine, one end of the tool may be formed with a sharp cutting edge for puncturing the sealed edge of the cover to enable the tool and leader to pass therethrough. The other end of the tool may be provided with a handle, or attached to a mechanical device for automated processing. The tool may be inserted into the slot in one direction, and pulled out of the slot in the same or alternatively in the opposite direction after the adhesive portion of the leader is adhered thereto, depending on the end of the tool to which the leader is attached. Where one transverse edge of the cover is sealed, the tool may be pushed through and puncture the sealed end of the cover at the respective end of the slot first, or alternatively be pushed into the slot through the opposite unsealed end and puncture the sealed edge of the cover after traversing the length of the slot.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 4:
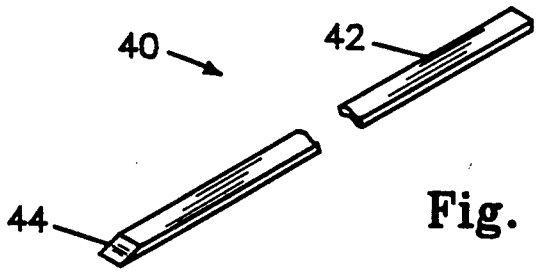
FIG. 4 is an isometric view of a first embodiment of a label leader insertion tool embodying the present invention.

Referring now to FIG. 4 of the drawing, a label leader insertion tool 40 embodying the present invention is illustrated for inserting the label leader 26 into the slot 24 of the binder 10. The binder 10 is generally the same as described with reference to FIGS. 1 and 2 above, except that the label leader 26 is not assembled to the binder 10 at the time of manufacture, and is to be retrofit to the binder 10 using the method of the invention. A binder 10 for standard loose-leaf sheets will typically have a slot 24 sized to accept flexible labels 30 made of paper or the like which are generally undersized as compared to the length and width of the slot 24. For one inch (2.5 cm) binders, the labels 30 will typically be approximately 2.1 cm wide and 28 cm long. The label leader 26 to be inserted into the slot 24 for subsequent insertion of a label 30 may be as wide as or wider than the label 30, but is preferably narrower than the label 30, typically 8 mm wide and 63.5 cm long, and is made of a strong, yet flexible plastic or other suitable material The overlay 22 of the binder 10 which defines the slot 24 will either not be sealed to the spine 12 at both of its transverse ends, or be completely sealed at one of its transverse ends as indicated at 34 with the cutout 36 omitted.

The leader insertion tool 40 illustrated in FIG. 4 generally includes a flat blade 42 made of surgical stainless steel or other material having the required properties. The blade 42 is sufficiently thin, preferably on the order of 0.4 mm thick, and sufficiently rigid to be easily pushed through the slot 24 of the binder 10. The blade 42 will generally have the same width as, or be slightly wider than the label leader 26, and be long enough to protrude from the opposite ends of the slot 24 by a sufficient amount to practice the invention. The blade 42 should be at least 33 cm long for a standard loose-leaf binder. The additional requirement for the blade 42 is that it be made of a material to which the adhesive portion 28 of the label leader 26 may be releasably adhered. Where one transverse edge of the overlay 22 is sealed to the spine 12, a cutting edge 44 is formed at one end portion or edge of the blade 42 which is sufficiently sharp to puncture the sealed edge of the overlay 22. Although the cutting edge 44 is shown as having a perpendicular or chisel type shape, it may have a diagonal, sharp pointed, or any other suitable shape within the scope of the invention.

A first method of practicing the present invention using the tool 40 is illustrated in FIGS. 5*a* to 5*d*. In the simplified diagrams which will be described below, both longitudinal edges of the overlay 22 are sealed to the spine 12 as indicated at 46. A first transverse end 24*a* of the slot 24 into which the label leader 26 is pulled by the tool 40 is defined by a first transverse edge 22*a* of the overlay 22. A second transverse end 24*b* of the slot 24 out of which the end of the label leader 26 formed with the adhesive portion 28 is pulled is defined by a second transverse edge 22*b* of the overlay 22.

Figure 5A:
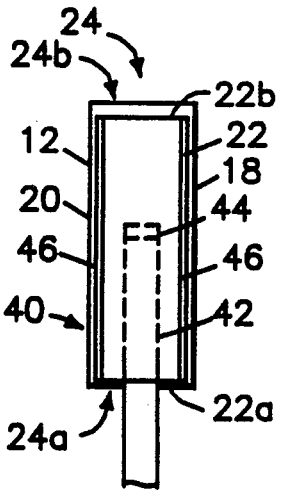
FIGS. 5*a* to 5*d* are simplified diagrams illustrating a first embodiment of a method of the present invention utilizing the tool of FIG. 4.

In FIG. 5*a*, the lower or first transverse edge 22*a* of the overlay 22 is sealed to the spine 12 of the binder 10 to thereby seal the lower or first end 24*a* of the slot 24. The leader insertion tool 40 is inserted into the slot 24 from the first end 24*a* thereof using the cutting edge 44 of the tool 40 to puncture the center portion of the sealed first end 22*a* of the overlay 22. The tool 40 is pushed upwardly through the entire length of the slot 24 until an upper end portion of the tool 40 which is sufficiently long to be gripped protrudes from the upper or second end 24*b* of the slot 24. As further illustrated in FIG. 5*b*, the end of the label leader 26 on which the adhesive portion 28 is formed is attached to the protruding lower end of the tool 40 such that the adhesive portion 28 faces upwardly, and is releasably adhered by finger pressure to the lower surface of the blade 42 of the tool 40.

Figure 2:
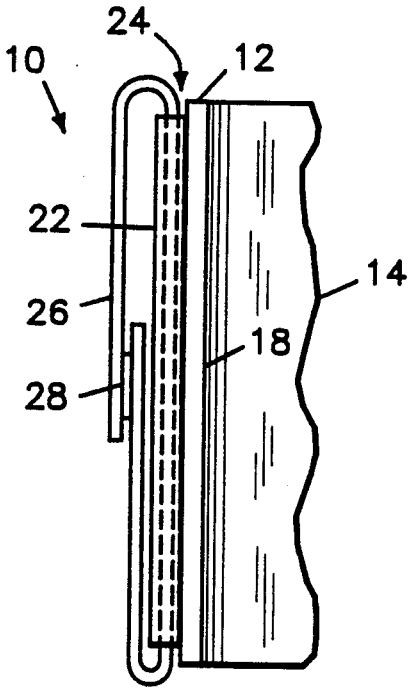
Fig. 2 (Prior Art)
FIG. 2 is a side elevation of the binder and label leader assembly shown in FIG. 1.
Figure 3A:
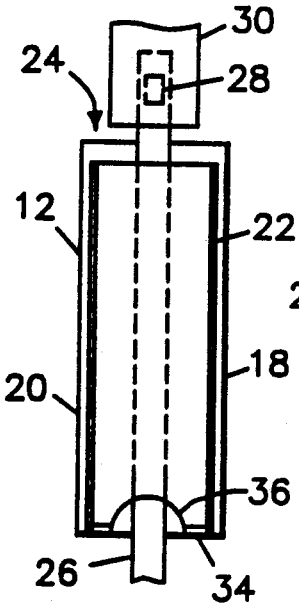
FIGS. 3*a* to 3*d* are simplified diagrams illustrating the use of the binder and label leader assembly of FIGS. 1 and 2.
Figure 3B:
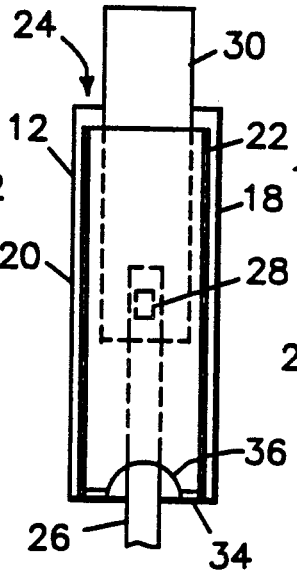
Figure 3C:
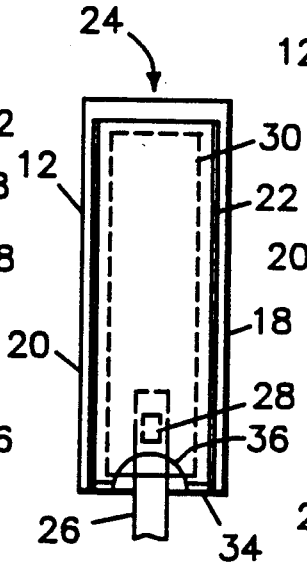
Figure 3D:
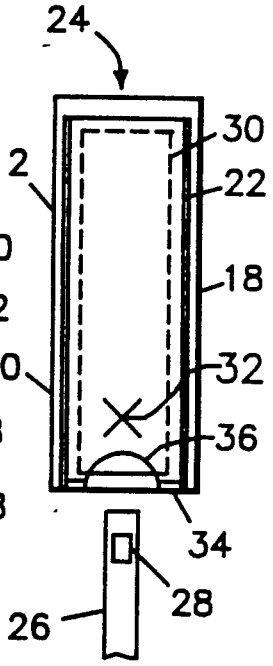
Fig. 3d (Prior Art)

The upper end of the tool 40 is then gripped, and pulled upwardly, thereby pulling the leader 26 upwardly into the slot 24. The leader 26 has been pulled approximately half way into the slot 24 in FIG. 5*c*, whereas it has been pulled completely into the slot 24 in FIG. 5*d* such that the upper end of the leader 26 on which the adhesive portion 28 is formed protrudes from the upper or second end 24*b* of the slot 24. Finger pressure is then applied to the leader 26 through the overlay 22 at a position such as designated by a cross 48, and the tool 40 is pulled upwardly with greater force until the blade 42 of the tool 40 detaches from the adhesive portion 28 of the leader 26. Although not illustrated, the upper end of the leader 26 is then pulled further upwardly through the slot 24, and the opposite ends of the leader 26 folded over the spine 12 and releasably adhered together as shown in FIG. 2.

Figure 5B:
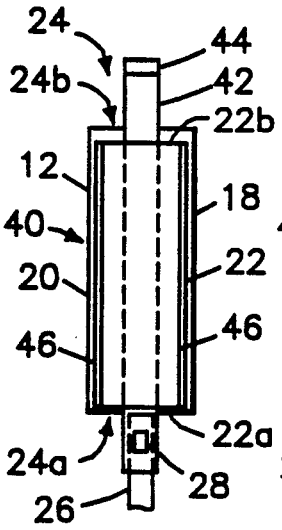

It will noted that the steps of FIGS. 5*a* and 5*b* may be reversed within the scope of the present invention. The leader 26 may be attached to the lower end of the tool 40 first, and the upper end of the tool 40 subsequently inserted into the slot 24.

FIGS. 6*a* to 6*d* illustrate a second embodiment of the present method which is similar to the first embodiment. The difference between the two is that in FIGS. 6*a* to 6*d*, the upper or second edge 22*b* of the overlay 22 is sealed to the spine 12 to thereby seal the second end 24*b* of the slot 24. In this case, the tool 40 punctures the sealed second end 24*b* of the slot 24 after being pushed upwardly through the slot 24 from the first end 24*a* thereof. The end of the leader 26 on which the adhesive portion 28 is provided protrudes from the sealed end of the slot, rather than from the open end as in FIGS. 5*a* to 5*d*. If the blade 42 of the tool 40 had the same width as the leader 26 as in the embodiment of FIGS. 5*a* to 5*d*, the punctured hole in the sealed end of the slot 24 would not be wide enough to enable the label 30 to be pulled into the slot 24 by the leader 26. However, this problem may be overcome by making the blade 42 of the tool 40 the same width or slightly wider than the label 30, to puncture a sufficiently wide hole in the sealed end of the slot 24 to enable the label 30 be pulled therethrough into the slot 24. This problem will not exist, of course, if the leader 26 is as wide or wider than the label 30, or if both ends of the slot 24 are unsealed.

Figure 7:
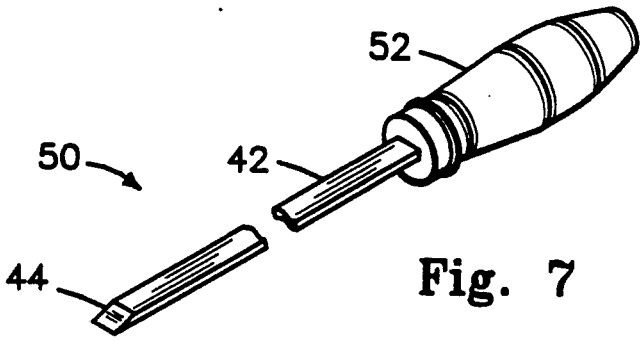
FIG. 7 is an isometric view of a second embodiment of a label leader insertion tool embodying the present invention.

An alternative embodiment of the present leader insertion tool is illustrated in FIG. 7, and designated as 50. The tool 50 includes the blade 42 formed with the cutting edge 44 in the same manner as the tool 40, but further includes a handle 52. The handle 52 may have any suitable shape such as similar to a chisel or file handle as illustrated, or a simple knob or loop (not shown). The handle 52 facilitates pushing the blade 42 into the slot 24 in one direction, as well as pulling the blade 42 out of the slot 24 in the opposite direction as will be described below.

A third embodiment of the present method utilizing the tool 50 is illustrated in FIGS. 8*a* to 8*d*. The first end 24*a* of the slot 24 is sealed as in FIGS. 5*a* to 5*d*. As viewed in FIG. 8*a*, the lower end of the tool 50 which is formed with the cutting edge 44 is inserted into the slot 24 from the upper second end 24*b* thereof, and pushed downwardly until it punctures the sealed edge 22*a* of the overlay 22. The end of the leader 26 formed with the adhesive portion 28 is attached to the lower end of the tool 50, and the tool 50 is pulled upwardly out of the slot 24 and the leader 26 is thereby pulled into the slot 24 in the same manner as described with reference to FIGS. 5*c* and 5*d*.

Figure 8A:
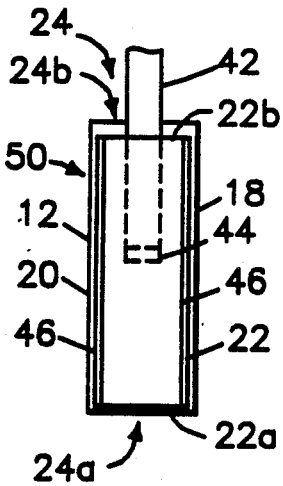
FIGS. 8*a* to 8*d* are simplified diagrams illustrating a third embodiment of a method of the present invention utilizing the tool of FIG. 7.
Figure 8B:
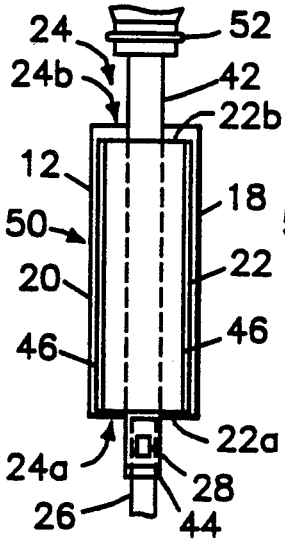
Figure 8C:
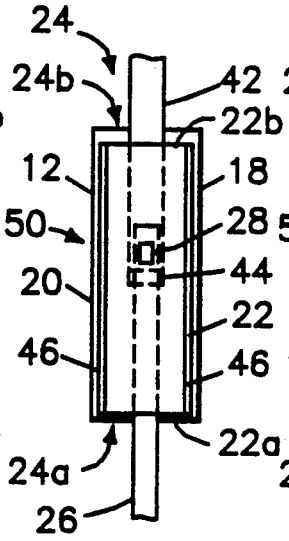
Figure 8D:
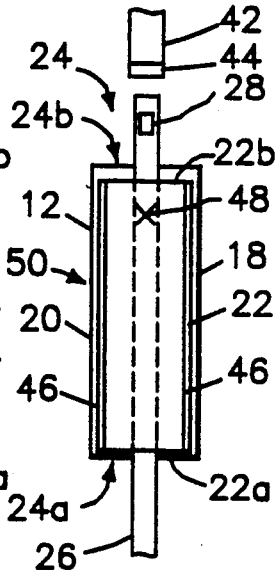
Figure 9A:
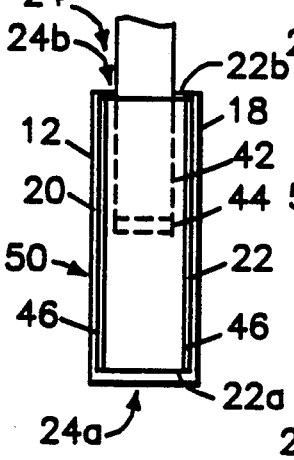
FIGS. 9*a* to 9*d* are simplified diagrams illustrating a fourth embodiment of the present method utilizing the tool of FIG. 7.
Figure 9B:
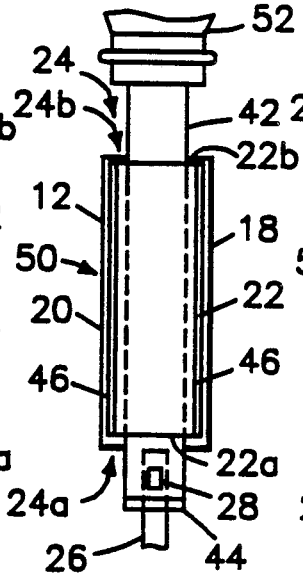
Figure 9C:
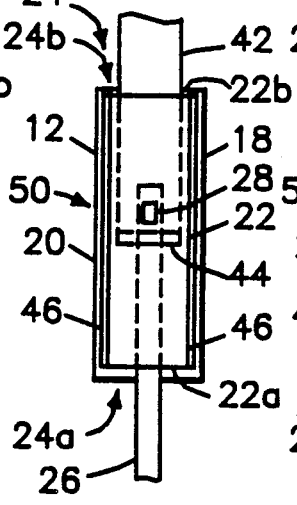
Figure 9D:
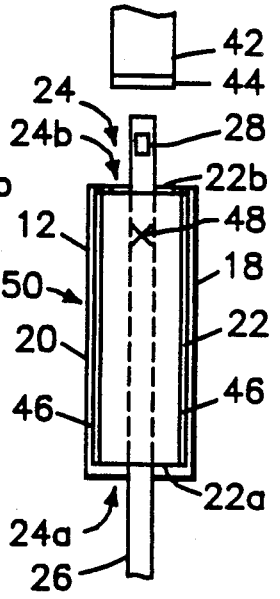

A fourth embodiment of the present method is illustrated in FIGS. 9*a* to 9*d*, and is similar to the method of FIGS. 8*a* to 8*d* except that the upper or second end 24*b* of the slot 24 is sealed, rather than the lower end as in FIGS. 8*a* to 8*c*. The cutting edge 44 of the tool 50 punctures the upper sealed end 24*b* on the way into the slot 24 as in the embodiment of FIGS. 6*a* to 6*d*. In a similar manner, the blade 42 of the tool 50 must be made at least as wide as the label 30 in order to enable the label 30 to be subsequently pulled into the slot 24 through the initially sealed upper end 24*b* thereof.

It will be noted that the tool 40 may be used to practice the methods of FIGS. 8*a* to 8*d* and 9*a* to 9*d*, as well as the methods of FIGS. 5*a* to 5*d* and 6*a* to 6*d*.

To summarize the four alternative embodiments of the present method, in the first embodiment of FIGS. 5*a* to 5*d*, the tool is pulled out of the slot in the same direction in which it is pushed in, and punctures the sealed transverse edge of the slot on the way in. In the second embodiment of FIGS. 6*a* to 6*d*, the tool is pulled out of the slot in the same direction in which it is pushed in, and punctures the sealed transverse edge of the slot on the way out. In the third embodiment of FIGS. 8*a* to 8*d*, the tool is pulled out of the slot in the direction opposite to which it is pushed in, and punctures the sealed transverse edge of the slot on the way in. In the fourth embodiment of FIGS. 9*a* to 9*d*, the tool is pulled out of the slot in the direction opposite to which it is pushed in, and punctures the sealed transverse edge of the slot on the way out.

It will be noted that if the slot 24 is initially unsealed at both transverse ends 22*a* and 22*b*, or if an initially sealed transverse end is cut or punctured using other means (not shown) prior to insertion of the leader 26, any of the alternative methods of the invention may be practiced using an insertion tool which does not have a cutting edge.

Figure 1:
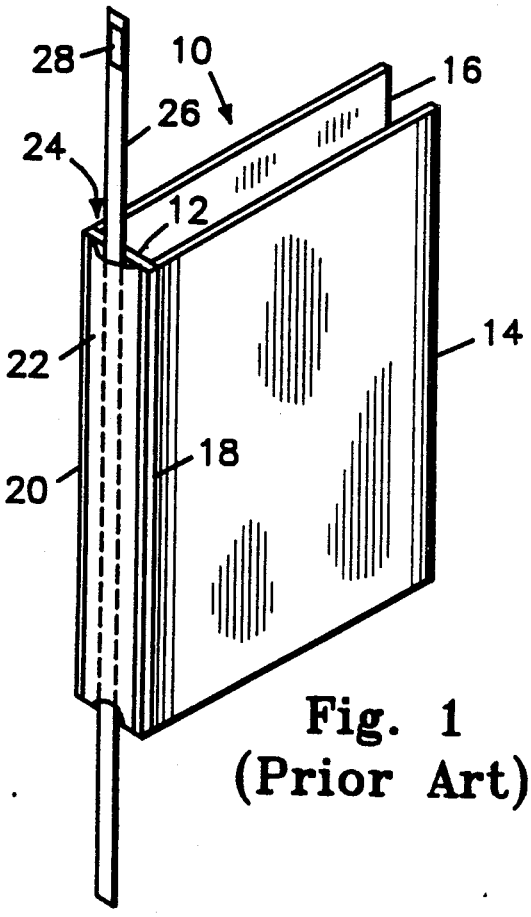
Fig. 1 (Prior Art)
FIG. 1 is an isometric view of a loose-leaf binder provided with a label leader in accordance with my above referenced prior patent.

Further, although the present method has been described and illustrated as being applied to insertion of a label leader into a slot on the end cover or spine 12 of a binder, it is equally applicable to insertion of a label leader provided on any portion of a cover of a bound work, such as the front and/or back covers 14 and 16 illustrated in FIG. 1.

Figure 10:
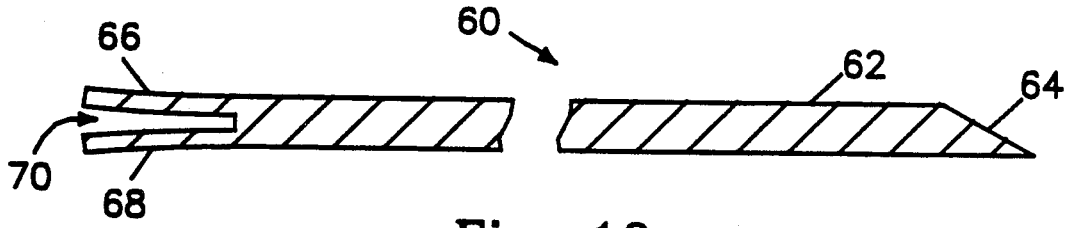
FIG. 10 is a sectional view of a third embodiment of a label leader insertion tool embodying the present invention.

Referring now to FIG. 10, a third label leader insertion tool 60 includes a blade 62 formed with a cutting edge 64 at its right end as viewed in the drawing. The left end of the blade 62 is split so as to form transverse bifurcations 66 and 68. A transverse slot 69 is defined between the bifurcations 66 and 68.

Figure 5C:
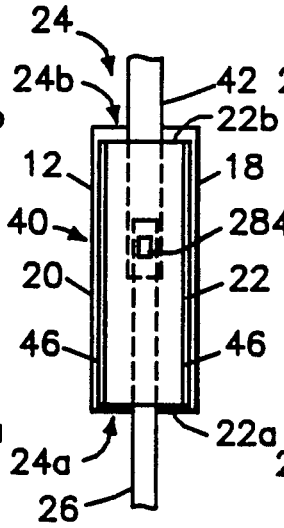
Figure 5D:
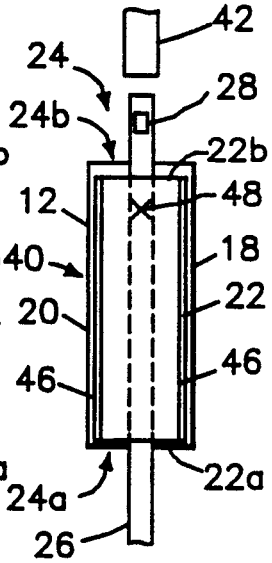
Figure 6A:
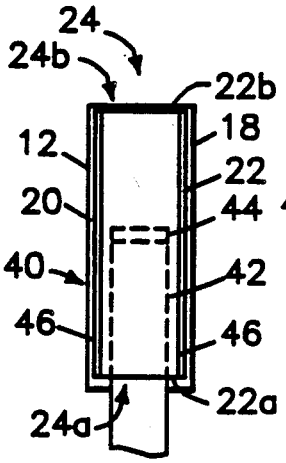
FIGS. 6*a* to 6*d* are simplified diagrams illustrating a second embodiment of the present method utilizing the tool of FIG. 4.
Figure 6B:
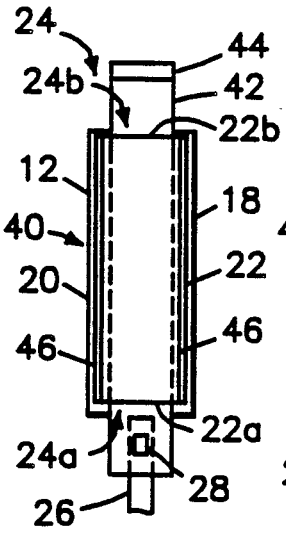
Figure 6C:
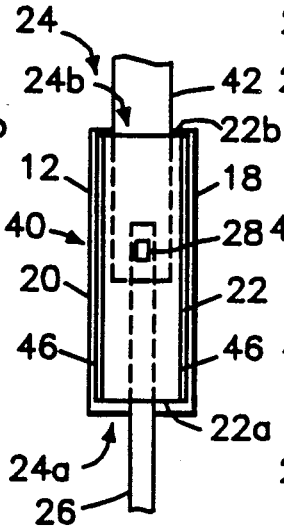
Figure 6D:
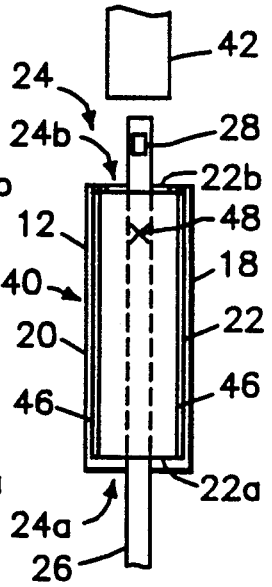

The tool 60 is applicable to performing the methods of FIGS. 5*a* to 5*d* and 6*a* to 6*d*, and is especially advantageous when applied to the method of FIGS. 6*a* to 6*d* as the blade 62 needs only be the same width as that of the tool 40 used for practicing the method of FIGS. 5*a* to 5c. This is because the bifurcations 66 and 68 constitute a gripping means for releasably gripping the end of the leader 26 opposite to the end which is formed with the adhesive portion 28. Thus, the method of FIGS. 6a to 6d practiced using the tool 60 to grip the opposite end of the leader 26 enables the end of the leader 26 on which the adhesive portion is formed to protrude from the unsealed end of the slot 24 as with the method of FIGS. 5a to 5d.

Figure 11A:
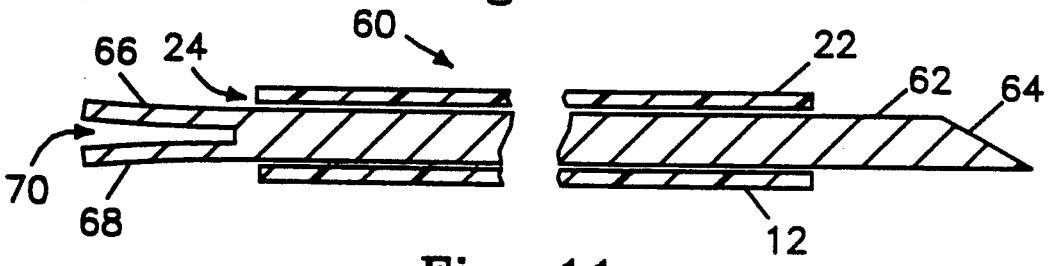
FIGS. 11*a* to 11*d* are simplified sectional views illustrating a fifth embodiment of the present method utilizing the tool of FIG. 10.

As viewed in FIG. 11a, the blade 62 of the tool 60 is inserted into the slot 24 from left to right as viewed in the drawing, puncturing either transverse end of the overlay 22 which is initially sealed. The bifurcations 66 and 68 protrude from the left end of the slot 24. The tool 60 is manufactured such that the bifurcations 66 and 68 flare away from each other, but are flexibly movable toward each other to grip the leader 26. Although not illustrated in the drawing, the inner surfaces of the bifurcations 66 and 68 which face each other may be provided with serrations or otherwise be roughened to increase the gripping force on the leader.

Figure 11B:
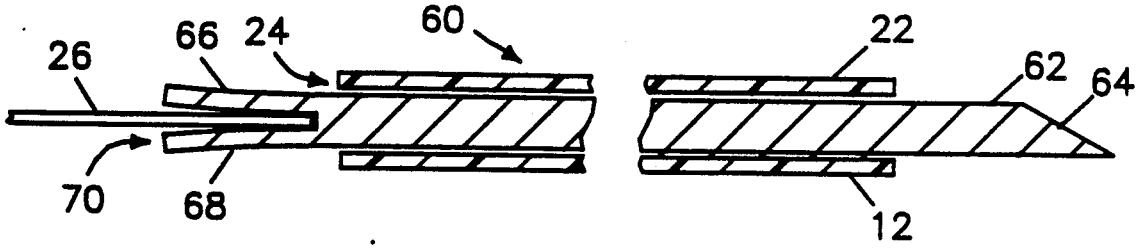
Figure 11C:
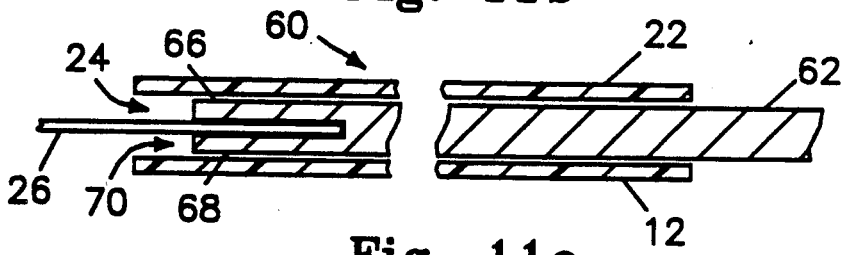
Figure 11D:
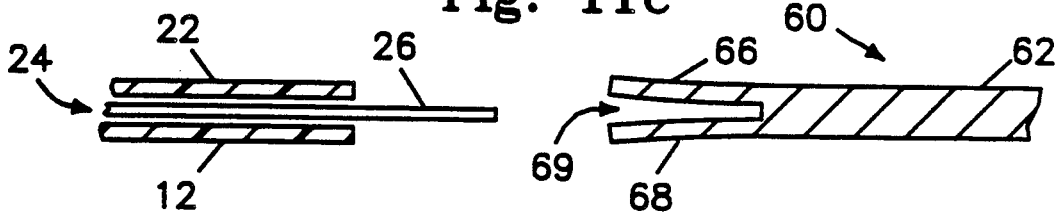

In FIG. 11b, the end of the leader 26 opposite to the end on which the adhesive portion 28 is formed is inserted into the slot 69 between the bifurcations 66 and 68. In FIG. 11c, the tool 60 is pulled rightwardly through the slot 24. The elastic force of the overlay 22 resiliently presses the bifurcations 66 and 68 toward each other to grip the end of the leader 26 with sufficient force to enable the leader 26 to be pulled through the slot 24 by the tool 60. In FIG. 11d, the blade 62 has been pulled completely through and out of the slot 24. The bifurcations 66 and 68 spring away from each other to release the end of the leader 26, which may subsequently be gripped by hand and pulled further out of the slot 24 for attachment to the end of the leader 26 on which the adhesive portion 28 is formed as illustrated in FIG. 2.

Figure 12:
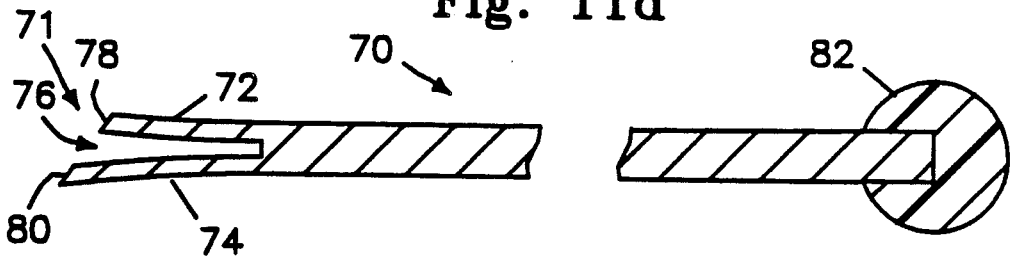
FIG. 12 is a sectional view of a fourth embodiment of a label leader insertion tool embodying the present invention.

A fourth embodiment of the present tool is illustrated in FIG. 12 and designated as 70. The tool 70 has a blade 71 formed with bifurcations 72 and 74 at the left end thereof as viewed in the drawing. The bifurcations 72 and 74 define a slot 76 therebetween into which the end of the leader 26 opposite to the end formed with the adhesive portion 28 may be inserted and gripped. The ends of the bifurcations 72 and 74 are formed with cutting edges 78 and 80 respectively for puncturing a sealed transverse edge of the slot 24. The tool 70 is further illustrated as having a handle in the form of a plastic knob 82 fixed to the right end thereof. The tool 70 is designed for practicing the methods of FIGS. 8a to 8d and 9a to 9d. For practicing the method of FIGS. 9a to 9d, the blade 71 needs be only as wide as the blade 62 for the reasons discussed above.

It will be noted that the tool 60 or 70 may also be used to pull the label 30 into the slot 24 without employing the leader 26.

The means for gripping the opposite end of the leader 26 are not limited to the resilient bifurcations illustrated in FIGS. 10 and 12, and are capable of numerous modifications within the scope of the invention. For example, one or both bifurcations may be rigid, and one or both bifurcations may be pivotally hinged to the blade for relative movement of the bifurcations toward and away from each other.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

I claim:

1. A method for inserting a label leader into a slot defined between a cover of a bound work and a transparent overlay which is sealed along its longitudinal edges to an outer surface of the cover, the slot having first and second transverse ends, the label leader being longer and narrower than the slot, the method comprising the steps of:

(a) providing a leader insertion tool which is longer and narrower than the slot, and sufficiently thin and rigid to be easily pushed and pulled through the slot;

(b) pushing the tool into the slot such that first and second end portions of the tool protrude from the first and second transverse ends of the slot respectively;

(c) releasably attaching an end of the leader to the first end portion of the tool;

(d) gripping the second end portion of the tool and pulling the tool out of the slot through the second transverse end thereof such that the leader is pulled into the slot through the first transverse end thereof and said end of the leader protrudes from the second transverse end of the slot; and (e) releasing said end of the leader from the first end portion of the tool.

2. A method as in claim 1, in which step (b) comprises pushing the tool into the slot from the first end thereof.

3. A method as in claim 1, in which the overlay has first and second transverse edges at the first and second transverse ends of the slot respectively, the first transverse edge being sealed to the outer surface of the cover to thereby seal the first transverse end of the slot:

step (b) comprising pushing the tool into the slot from the first end thereof and puncturing the sealed first transverse edge of the overlay.

4. A method as in claim 3, in which step (a) comprises providing the tool as having the second end portion thereof formed with a cutting edge which is sufficiently sharp to puncture the sealed first transverse edge of the overlay in step (b).

5. A method as in claim 1, in which the overlay has first and second transverse edges at the first and second transverse ends of the slot respectively, the second transverse edge being sealed to the outer surface of the cover to thereby seal the second transverse end of the slot:

step (b) comprising pushing the tool into the slot from the first end thereof and puncturing the sealed second transverse edge of the overlay.

6. A method as in claim 5, in which step (a) comprises providing the tool as having the second end portion thereof formed with a cutting edge which is sufficiently sharp to puncture the sealed second transverse edge of the overlay in step (b).

7. A method as in claim 1, in which step (b) comprises pushing the tool into the slot from the second end thereof.

8. A method as in claim 1, in which the overlay has first and second transverse edges at the first and second transverse ends of the slot respectively, the first transverse edge being sealed to the outer surface of the cover to thereby seal the first transverse end of the slot:

step (b) comprising pushing the tool into the slot from the second end thereof and puncturing the sealed first transverse edge of the overlay.

9. A method as in claim 8, in which step (a) comprises providing the tool as having the first end portion thereof formed with a cutting edge which is sufficiently sharp to puncture the sealed first transverse edge of the overlay in step (b).

10. A method as in claim 1, in which the overlay has first and second transverse edges at the first and second transverse ends of the slot respectively, the second transverse edge being sealed to the outer surface of the cover to thereby seal the second transverse end of the slot:

step (b) comprising pushing the tool into the slot from the second end thereof and puncturing the sealed second transverse edge of the overlay.

11. A method as in claim 10, in which step (a) comprises providing the tool as having the first end portion thereof formed with a cutting edge which is sufficiently sharp to puncture the sealed second transverse edge of the overlay in step (b).

12. A method as in claim 1, in which:

the leader has an adhesive portion formed at said end thereof;

step (c) comprises releasably adhering the adhesive portion of the leader to the first end portion of the tool; and step (e) comprises releasing the adhesive portion of the leader from the first end portion of the tool.

13. A method for inserting a label leader into a slot defined between a cover of a bound work and a transparent overlay which is sealed along its longitudinal edges to an outer surface of the cover, the slot having first and second transverse ends, the label leader being longer and narrower than the slot and having an adhesive portion at an end thereof, the method comprising the steps of:

(a) providing a leader insertion tool which is longer and narrower than the slot, and sufficiently thin and rigid to be easily pushed and pulled through the slot;

(b) releasably adhering the adhesive portion of the leader to a first end portion of the tool;

(c) pushing the tool into the slot such that first and second end portions of the tool protrude from the first and second transverse ends of the slot respectively;

(d) gripping the second end portion of the tool and pulling the tool out of the slot through the second transverse end thereof such that the leader is pulled into the slot through the first transverse end thereof and the adhesive portion of the leader protrudes from the second transverse end of the slot; and (e) releasing the adhesive portion of the leader from the first end portion of the tool.

14. A tool for inserting a label leader into a slot defined between a cover of a bound work and a transparent overlay which is sealed along its longitudinal edges and one transverse edge to an outer surface of the cover, the label leader being longer and narrower than the slot and having an adhesive portion at an end thereof which is releasably adherable to the tool;

the tool being longer and narrower than the slot, and sufficiently thin and rigid to be easily pushed and pulled through the slot; the tool being further formed with a cutting edge at an end thereof which is sufficiently sharp to puncture the sealed transverse edge of the overlay.

15. A tool as in claim 14, further comprising a handle provided at an end thereof which is opposite to said end.

16. A tool as in claim 14, having a width which is substantially equal to a width of the leader.

17. A tool for inserting a label leader into a slot defined between a cover of a bound work and a transparent overlay which is sealed along its longitudinal edges to an outer surface of the cover, the label leader being longer and narrower than the slot;

the tool being longer an d narrower than the slot, and sufficiently thin and rigid to be easily pushed and pulled through the slot;

the tool further including gripping means provided at an end thereof for releasing gripping an end of the leader with sufficient force to pull the leader through the slot;

the overlay being sealed at one transverse edge thereof to the outer surface of the cover; and the tool being further formed with a cutting edge at an end thereof which is sufficiently sharp to puncture the sealed transverse edge of the overlay.

18. A tool as in claim 17, in which the cutting edge is formed at the same end of the tool as the gripping means.

19. A tool as in claim 17, in which the cutting edge is formed at an opposite end of the tool from the gripping means.

20. A tool as in claim 17, in which the gripping means comprises first and second transverse bifurcations formed at said end of the tool, at least one of the bifurcations being movable toward and away from the other bifurcation for releasably gripping the end of the leader between the bifurcations.

* * * * *